US008002433B1

(12) United States Patent
Cucksey et al.

(10) Patent No.: US 8,002,433 B1
(45) Date of Patent: Aug. 23, 2011

(54) DECORATIVE LIGHT MOUNT APPARATUS

(76) Inventors: Douglas D. Cucksey, Corunna (CA); Diane E. Cucksey, Corunna (CA)

( * ) Notice: Subject to any disclaimer, the term of this patent is extended or adjusted under 35 U.S.C. 154(b) by 0 days.

(21) Appl. No.: 12/958,513

(22) Filed: Dec. 2, 2010

(51) Int. Cl.
*F21S 4/00* (2006.01)

(52) U.S. Cl. ..... 362/219; 362/427; 362/217.01; 362/249.02; 362/249.16; 362/428

(58) Field of Classification Search ..... 362/145–150, 362/217.01, 219, 225, 217.1, 217.11–217.17, 362/227, 249.01, 249.02, 249.11, 249.16, 362/368, 370, 382, 427, 428
See application file for complete search history.

(56) References Cited

U.S. PATENT DOCUMENTS

| | | | | | |
|---|---|---|---|---|---|
| 3,692,993 | A | * | 9/1972 | Robinson | 362/249.07 |
| 4,974,128 | A | * | 11/1990 | Prickett | 362/145 |
| 4,977,490 | A | * | 12/1990 | Davies | 362/221 |
| 5,249,108 | A | * | 9/1993 | Gary | 362/388 |
| 5,311,414 | A | | 5/1994 | Branham, Sr. | |
| 5,345,369 | A | * | 9/1994 | Ruud et al. | 362/145 |
| 5,388,802 | A | * | 2/1995 | Dougan et al. | 248/74.2 |
| 5,404,279 | A | | 4/1995 | Wood | |
| 5,510,966 | A | * | 4/1996 | Konecny | 362/249.16 |
| 5,594,628 | A | | 1/1997 | Reuter et al. | |
| 5,813,751 | A | | 9/1998 | Shaffer | |
| 5,816,687 | A | * | 10/1998 | Tapp | 362/249.01 |
| 6,050,709 | A | * | 4/2000 | Hastings | 362/375 |
| 6,076,980 | A | * | 6/2000 | Piccinino et al. | 396/614 |
| 6,224,232 | B1 | | 5/2001 | Rodriguez | |
| 6,572,239 | B1 | | 6/2003 | Harbin | |
| 6,918,680 | B2 | * | 7/2005 | Seeberger | 362/150 |
| 7,306,354 | B2 | * | 12/2007 | Haas | 362/432 |

* cited by examiner

*Primary Examiner* — Anabel M Ton
*Assistant Examiner* — Danielle Allen
(74) *Attorney, Agent, or Firm* — Crossley Patent Law; Mark A. Crossley

(57) ABSTRACT

The decorative light mount apparatus provides for permanent support of lights and light strings to a structure. The right angle member provides for light wiring to be wire tired or fastened otherwise, to the gapped risers of the tie plates, so that lights are extended from the horizontal length of the right angle member. The right angle member is supported on a structure via the hinge that is fastened to the right angle member. The hinge allows the right angle member to be pivoted, positioning the vertical length of the right angle member either vertically upward, vertically downward, or even angled from the downward vertical. The lock member provides fastening of the right angle member so that the lights are visibly concealed. Release of the wing nut allows the right angle member to pivot upwardly to position lights in a downward and visible mode.

7 Claims, 6 Drawing Sheets

DECORATIVE LIGHT MOUNT APPARATUS

BACKGROUND OF THE INVENTION

Attaching strings of lights and especially exterior Christmas season lights is seldom less than arduous. Typically cold weather, ladder difficulties and dangers, light string entanglement, bulb breakage, and successful and pleasing mounting are but a few of the challenges often faced annually by those in pursuit of decorative and other lighting. The present apparatus provides a solution to stringing numerous lights.

FIELD OF THE INVENTION

The decorative light mount apparatus relates to the installation of strings of lights and more especially to an apparatus that enables permanent attachment of light strings with ease of display and concealment.

SUMMARY OF THE INVENTION

The general purpose of the decorative light mount apparatus, described subsequently in greater detail, is to provide a decorative light mount apparatus which has many novel features that result in an improved decorative light mount apparatus which is not anticipated, rendered obvious, suggested, or even implied by prior art, either alone or in combination thereof.

To attain this, the decorative light mount apparatus provides for permanent support of lights and light strings to a structure. The structure may best receive the apparatus by its facing that is typically adjacent to soffit and the like, but the apparatus is not confined to such applications. The right angle member may provide for light wiring to be wire tired or fastened otherwise, to the gapped risers of the tie plates, so that lights are extended from the horizontal length of the right angle member. Wire ties and other semi-permanent attachment means provide for light and light string removal with little trouble. Importantly, the pivot bolts are removably installed into the partial sleeves of the right angle members so that removal may be easily accomplished. The right angle member is supported on a structure via the hinge that is fastened to the right angle member. The hinge and right angled member may be removably or permanently fastened together. While the right angle member may be provided in angle other than right, production and sales costs are enhanced by the right angle versus other angles between the horizontal member and the vertical member.

The hinge allows the right angle member to be pivoted, positioning the vertical length of the right angle member either vertically upward, vertically downward, or even angled from the downward vertical. The lock member provides for fastening to the right angle member so that the lights are visibly concealed. Release of the wing nut allows the right angle member to pivot upwardly to position lights in a downward and visible mode. Separate attachment of the right angle member and lock member to a structure provide for a variety of attachments to best suit individual taste and various structures.

Various means may be used to hold the angle member or right angle member in a vertically upright mode. Those means may include fasteners, wire ties and the illustrated pivotal latch. Various lock members may be provided. Lock members may include basic devices for selective attachment to the angle and right angle members. The lock member may include an orifice or a slot for t-bolt receipt. The t-bolt may be excluded and various other means used to selectively fasten the angle member or right angle member to the lock member.

While the apparatus can be unfastened from a structure, permanent fastening enables easy and convenient pivot of the right angle member, as opposed to the problems and difficulties of hanging lights and light strings in typical fashion that is fraught with danger and difficulty.

The hinges may be installed in spaced apart arrangement along a length of the right angle member. The hinges may be fastened to the right angle member by a user and may also be permanently attached to the bottom of the vertical length of the vertical members.

Thus has been broadly outlined the more important features of the improved decorative light mount apparatus so that the detailed description thereof that follows may be better understood and in order that the present contribution to the art may be better appreciated.

An object of the decorative light mount apparatus is to selectively and permanently install lighting strings.

Another object of the decorative light mount apparatus is to provide for concealment of lights when not in use.

A further object of the decorative light mount apparatus is to provide an aesthetically pleasing apparatus for light display, whether in concealed mode or display mode.

An added object of the decorative light mount apparatus is to correctly align lights.

And, an object of the decorative light mount apparatus is to provide for easily attaching lights.

Still another object of the decorative light mount apparatus is to provide for easily removing lights.

These together with additional objects, features and advantages of the improved decorative light mount apparatus will be readily apparent to those of ordinary skill in the art upon reading the following detailed description of presently preferred, but nonetheless illustrative, embodiments of the improved decorative light mount apparatus when taken in conjunction with the accompanying drawings.

DETAILED DESCRIPTION OF THE DRAWINGS

With reference now to the drawings, and in particular FIGS. 1 through 7 thereof, the principles and concepts of the decorative light mount apparatus generally designated by the reference number 10 will be described.

Figure 3:
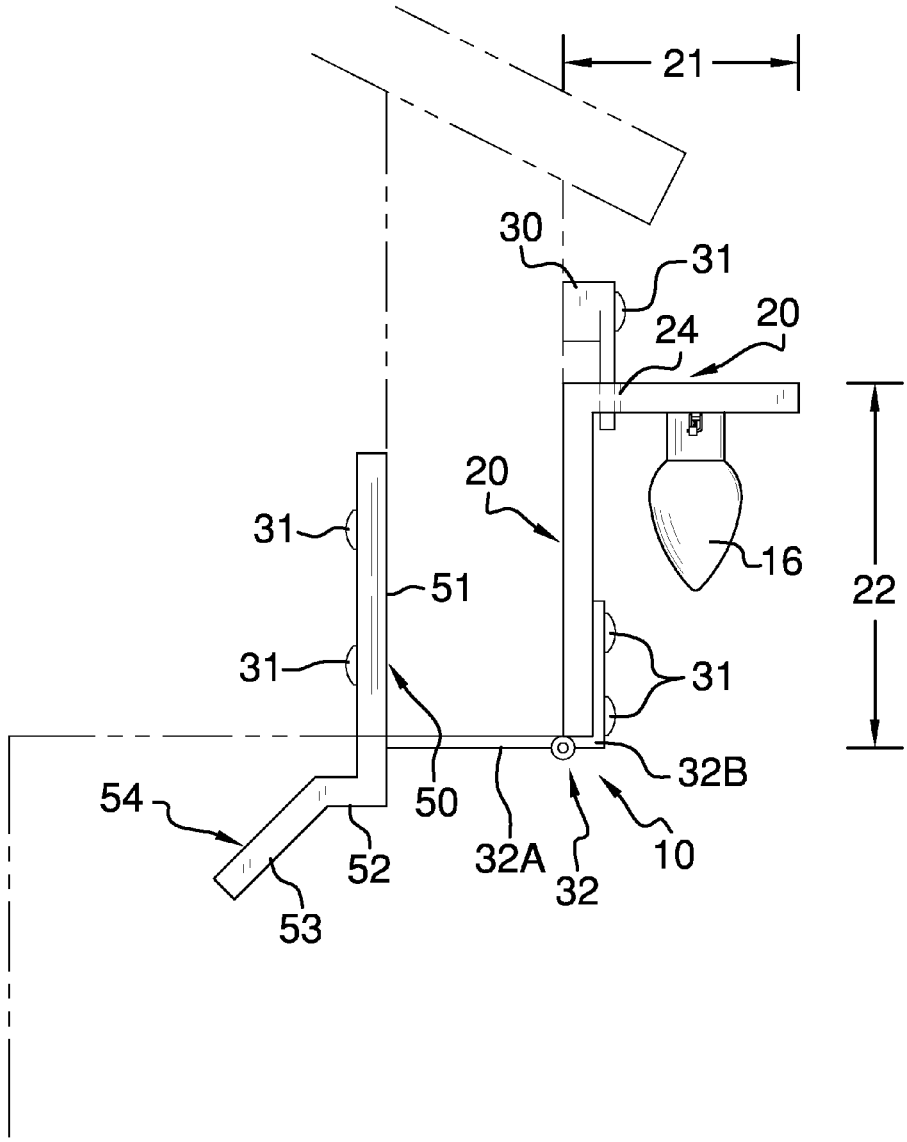
FIG. 3 is a lateral elevation view of the installed apparatus in light display mode.

Referring to FIG. 3, the apparatus 10 partially comprises a right angle member 20 having a horizontal length 21 and a vertical length 22. A plurality of spaced apart notches 24 is disposed within the horizontal length 21. The notches 24 are proximal to the vertical length 22.

Figure 4:
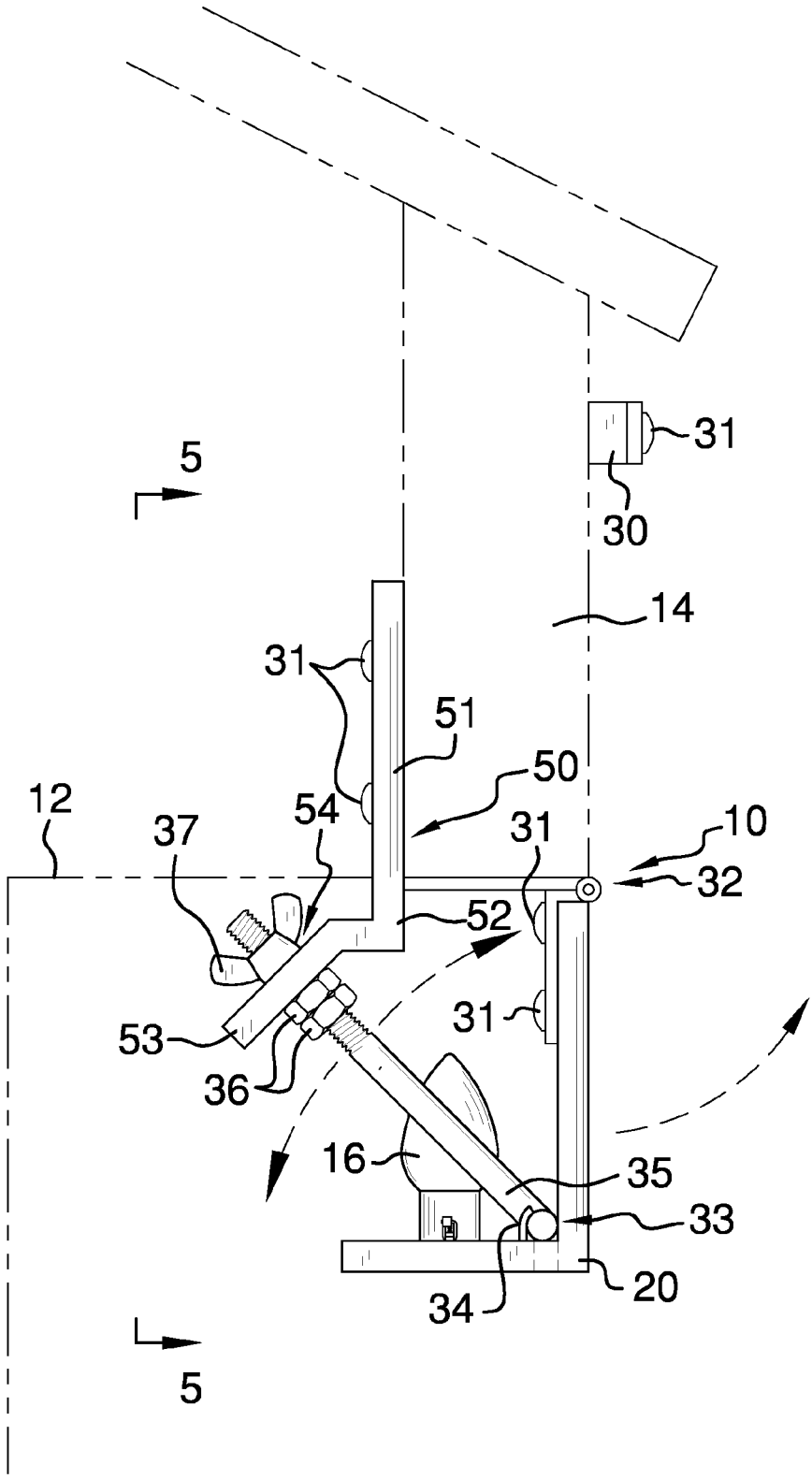
FIG. 4 is a lateral elevation view of the installed apparatus in light concealed mode.

Referring to FIG. 4, the pivot 33 is disposed within the right angle member 20 at the horizontal length 21 and vertical length 22.

Figure 5:
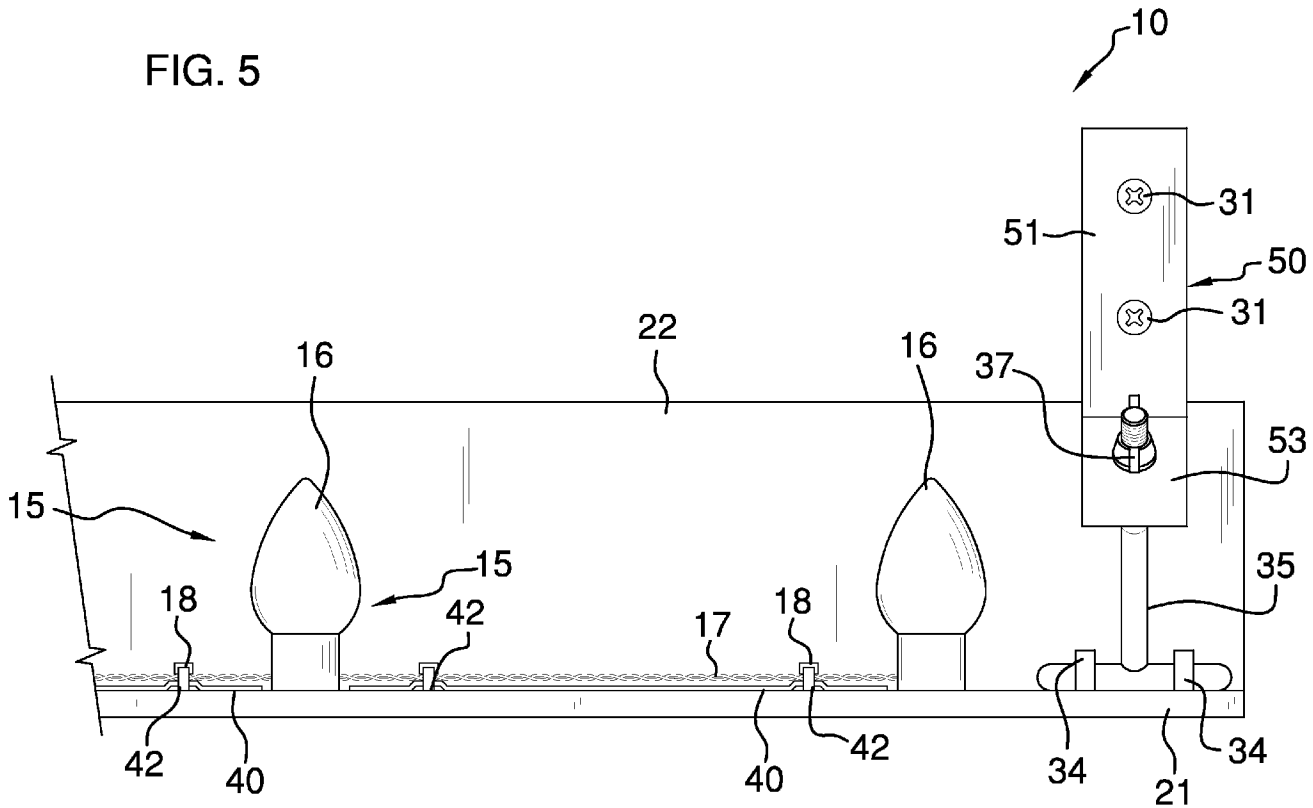
FIG. 5 is a rear elevation view of the installed apparatus in light concealed mode.

Continuing to refer to FIG. 4 and referring also to FIG. 5, the pair of spaced apart partial sleeves 34 is extended downwardly on the horizontal length 21 at the pivot 33. The t-bolt 35 is removably and pivotally contained by the partial sleeves 34.

Referring again to FIGS. 3 and 4, each of a plurality of hinges 32 is disposed downwardly on the vertical length 22. Each hinge 32 comprises a straight member 32A hingedly connected to the hinge right angled member 32B. The hinge right angled member 32B is fastened to the right angle member 20 vertical length 22 distal from the horizontal length 21. The hinge 32 straight member 32A is selectively fastened below an existing facing 14.

Referring to FIGS. 3, 4, and 5, the lock member 50 is selectively fastened to a rear of the existing facing 14. The lock member 50 comprises an upright 51 affixed to a right angle 52. The downward angle 53 is extended from the right angle 52. An orifice 54 is disposed within the downward angle 53. The t-bolt 35 of the right angle member 20 horizontal length 21 partial sleeves 34 is selectively held within the lock member 50 orifice 54 by at least a lock nut 36 and a wing nut 37. More than one lock nut 36 is often used, as is illustrated.

Referring again to FIGS. 3 and 4, a plurality of pivotal latches 30 is selectively affixed via fastener 31 to the existing facing 14 above the right angle member 20. Each latch 30 is removably pivoted within one of the plurality of the right angle member 20 notches 24, thereby selectively positioning the vertical length 22 of the right angle member 20 in an upright mode or downward mode, the horizontal length 21 thereby in a horizontal mode whether upwardly or downward.

Figure 1:
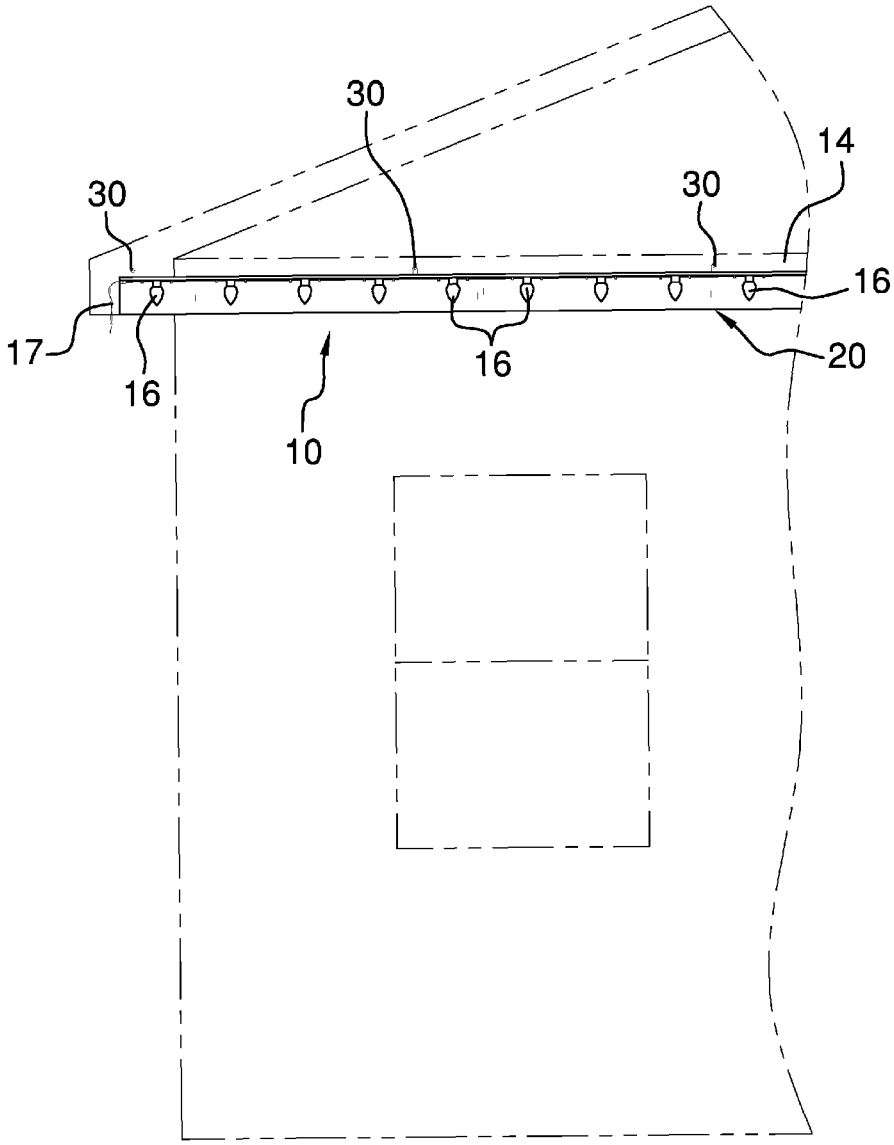
FIG. 1 is a front elevation view of the apparatus installed with lights in the display mode.

Referring to FIG. 1, the apparatus 10 right angle member 20 is pivoted such that the vertical length 22 is downwardly vertical with the horizontal length 21 holding the lights 16 in an exposed state.

Figure 2:
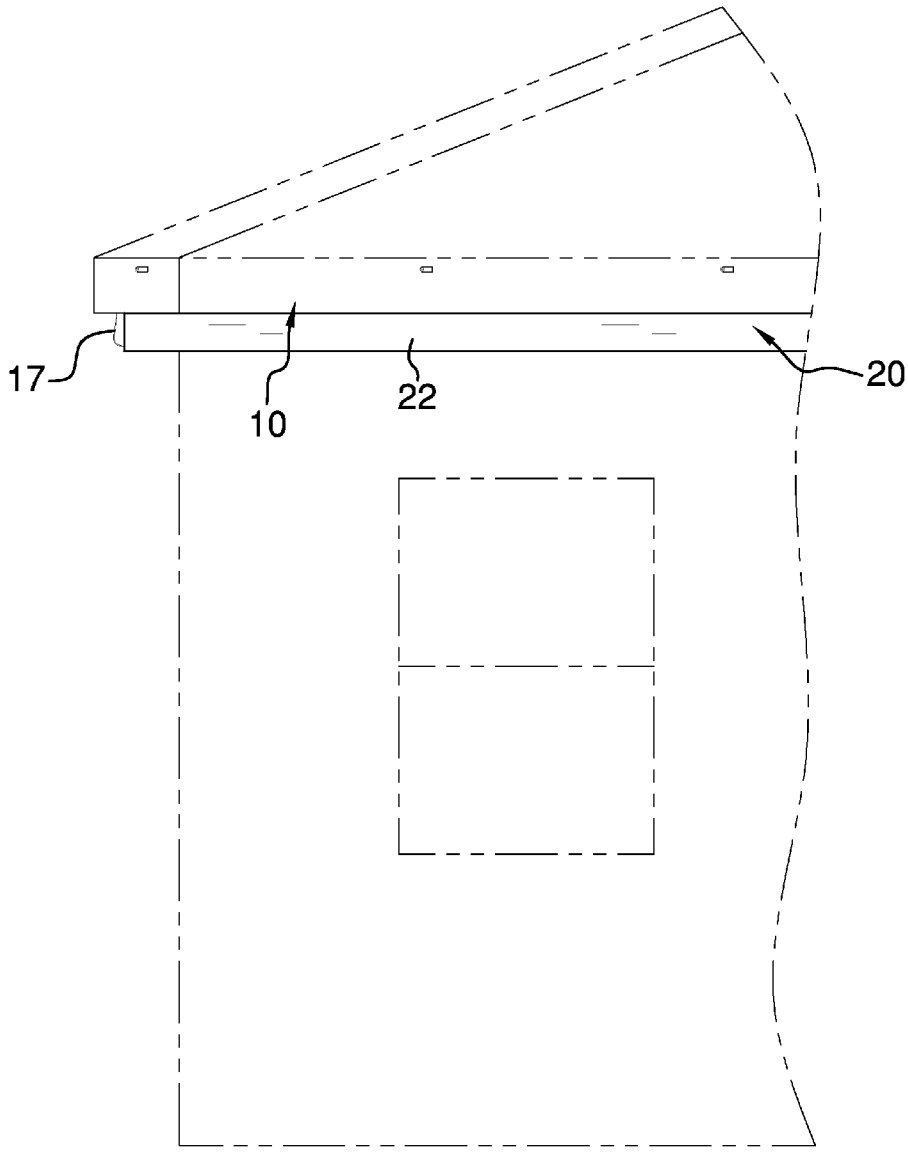
FIG. 2 is a front elevation view of the apparatus installed with lights in the concealed mode.

Referring to FIG. 2, the right angle member 20 vertical length 22 is pivoted to be in the vertically upright mode, thereby concealing the lights 16.

Referring again to FIG. 5, a plurality of spaced apart tie plates 40 is affixed interiorly to the horizontal length 21 of the right angle member 20. Each tie plate 40 further comprises a gapped riser 42.

Figure 7:
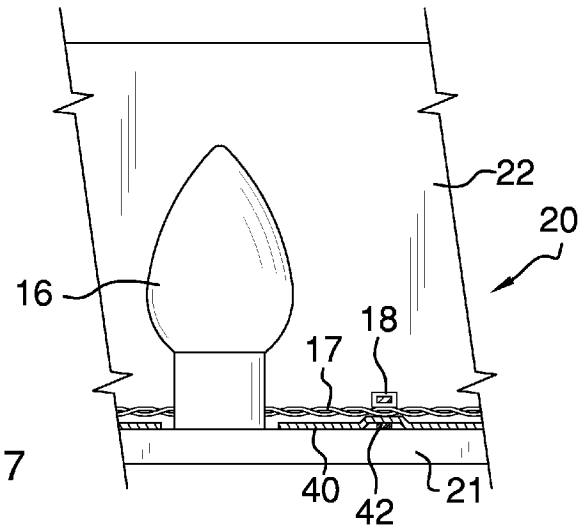
FIG. 7 is a front partial cross sectional view with tie plate and existing wire tie.

Referring to FIG. 7, each gapped riser 42 receives an existing wire tie 18 to hold existing wiring 17 of a light string 15.

Figure 6:
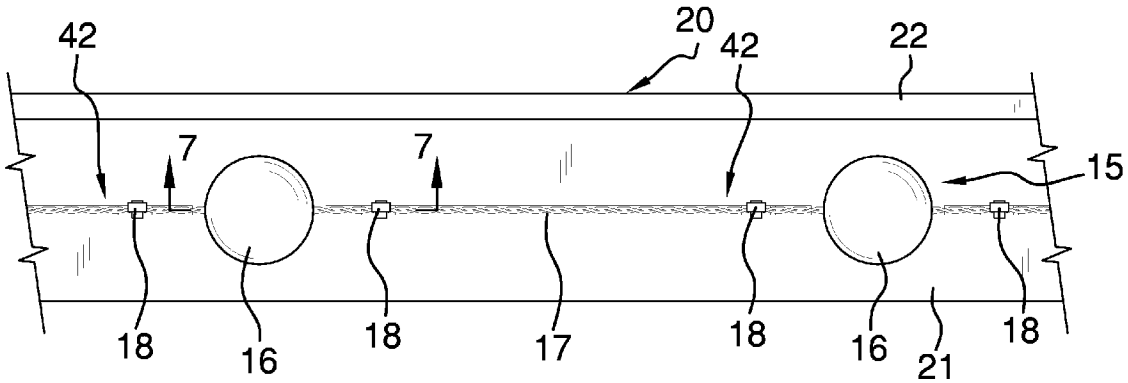
FIG. 6 is a top plan view of FIG. 5.

Referring to FIG. 6, each gapped riser 42 is spaced in sufficient proximity to the next such that wiring 17 of light strings 15 holds associated lights 16 and parts against the horizontal length 21.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the decorative light mount apparatus may be used.

What is claimed is:

1. A decorative light mount apparatus comprising, in combination:

an angle member having a horizontal length and a vertical length, a plurality of spaced apart notches disposed within the horizontal length, the notches proximal to the vertical length;

a pivot disposed within the angle member at the horizontal length and vertical length;

a pair of spaced apart partial sleeves extended downwardly on the horizontal length at the pivot;

a t-bolt removably and pivotally contained by the partial sleeves;

a plurality of hinges disposed downwardly on the vertical length, each hinge comprising a straight member hingedly connected to a hinge right angled member, the hinge right angled member fastened to the angle member vertical length distal from the horizontal length, the hinge straight member selectively fastened below an existing facing underside;

a lock member selectively fastened to a rear of the existing facing, the t-bolt of the horizontal length partial sleeves selectively held within the lock member;

a means for retaining the vertical member of the angle member in an upright vertical mode;

a plurality of spaced apart tie plates affixed interiorly to the horizontal length of the angle member, each tie plate further comprising a gapped riser.

2. The apparatus according to claim 1 wherein the angle member further comprises a right angle member.

3. The apparatus according to claim 1 wherein the lock member further comprises a notch in removable receipt of the t-bolt.

4. The apparatus according to claim 2 wherein the lock member further comprises a notch in removable receipt of the t-bolt.

5. The apparatus according to claim 1 wherein the lock member further comprises an orifice in removable receipt of the t-bolt.

6. The apparatus according to claim 2 wherein the lock member further comprises a notch in removable receipt of the t-bolt.

7. A decorative light mount apparatus comprising, in combination:

a right angle member having a horizontal length and a vertical length, a plurality of spaced apart notches disposed within the horizontal length, the notches proximal to the vertical length;

a pivot disposed within the right angle member at the horizontal length and vertical length;

a pair of spaced apart partial sleeves extended downwardly on the horizontal length at the pivot;

a t-bolt removably and pivotally contained by the partial sleeves;

a plurality of hinges disposed downwardly on the vertical length, each hinge comprising a straight member hingedly connected to a hinge right angled member, the hinge right angled member fastened to the right angle member vertical length distal from the horizontal length, the hinge straight member selectively fastened below an existing facing underside;

a lock member selectively fastened to a rear of the existing facing, the lock member comprising an upright affixed to a right angle, a downward angle extended from the right angle; an orifice disposed within the downward angle;

the t-bolt of the horizontal length partial sleeves selectively held within the lock member orifice by at least a lock nut and a wing nut;

a plurality of pivotal latches selectively affixed to the existing facing above the right angle member, each latch removably pivoted within one of the plurality of the right angle member notches, thereby selectively positioning the vertical length of the right angle member in a vertically upright mode or a vertically downward mode, the horizontal length thereby in a horizontal mode either upwardly or downwardly;

a plurality of spaced apart tie plates affixed interiorly to the horizontal length of the right angle member, each tie plate further comprising a gapped riser.

* * * * *